US005599187A

United States Patent [19]

Mesiano

[11] Patent Number: 5,599,187

[45] Date of Patent: Feb. 4, 1997

[54] FIREARM USE TRAINING DEVICE AND METHOD

[76] Inventor: Dominick N. Mesiano, 1976 N. East Ave., Lot 126, Vineland, N.J. 08360

[21] Appl. No.: 361,318

[22] Filed: Dec. 21, 1994

[51] Int. Cl.[6] ..... F41G 3/26

[52] U.S. Cl. ..... 434/19; 124/56

[58] Field of Search ..... 434/23, 19, 16, 434/11; 124/56, 16, 17, 77; 273/384, 311; 89/41.15, 36.13; 42/54

[56] References Cited

U.S. PATENT DOCUMENTS

| | | | |
|---|---|---|---|
| Re. 26,662 | 9/1969 | Hall | 124/77 |
| 502,759 | 8/1893 | Rapieff | 124/11 |
| 746,725 | 12/1903 | Meigs et al. | 89/36.13 |
| 1,743,576 | 1/1930 | Smith | 124/77 X |
| 2,569,594 | 10/1951 | Aagesen | 273/101.1 |
| 2,834,332 | 5/1958 | Guthrie | 89/41.15 X |
| 2,957,693 | 10/1960 | Ross | 273/311 X |
| 3,849,910 | 11/1974 | Greenly . | |
| 3,889,396 | 6/1975 | Aronson . | |
| 4,340,370 | 7/1982 | Marshall et al. | 434/22 |
| 4,482,325 | 11/1984 | Reimann | 434/21 |
| 4,934,937 | 6/1990 | Judd | 434/21 |
| 4,936,282 | 6/1990 | Dobbins et al. | 124/74 |
| 4,948,371 | 8/1990 | Hall | 434/21 |
| 5,095,433 | 3/1992 | Botarelli et al. | 364/423 |
| 5,320,358 | 6/1994 | Jones | 434/16 X |

*Primary Examiner*—Gene Mancene
*Assistant Examiner*—Jeffrey A. Smith
*Attorney, Agent, or Firm*—Thomas A. Lennox, Esq.

[57] ABSTRACT

A paint ball gun is protected by armor and is equipped with aiming mechanisms to allow the gun to be swiveled horizontally and raised or lowered using linear actuators controlled by hand held controllers distanced from and generally behind a person being trained in armed combat with the task of hitting targets located near the paint gun while avoiding being struck by a paint ball from the gun.

13 Claims, 3 Drawing Sheets

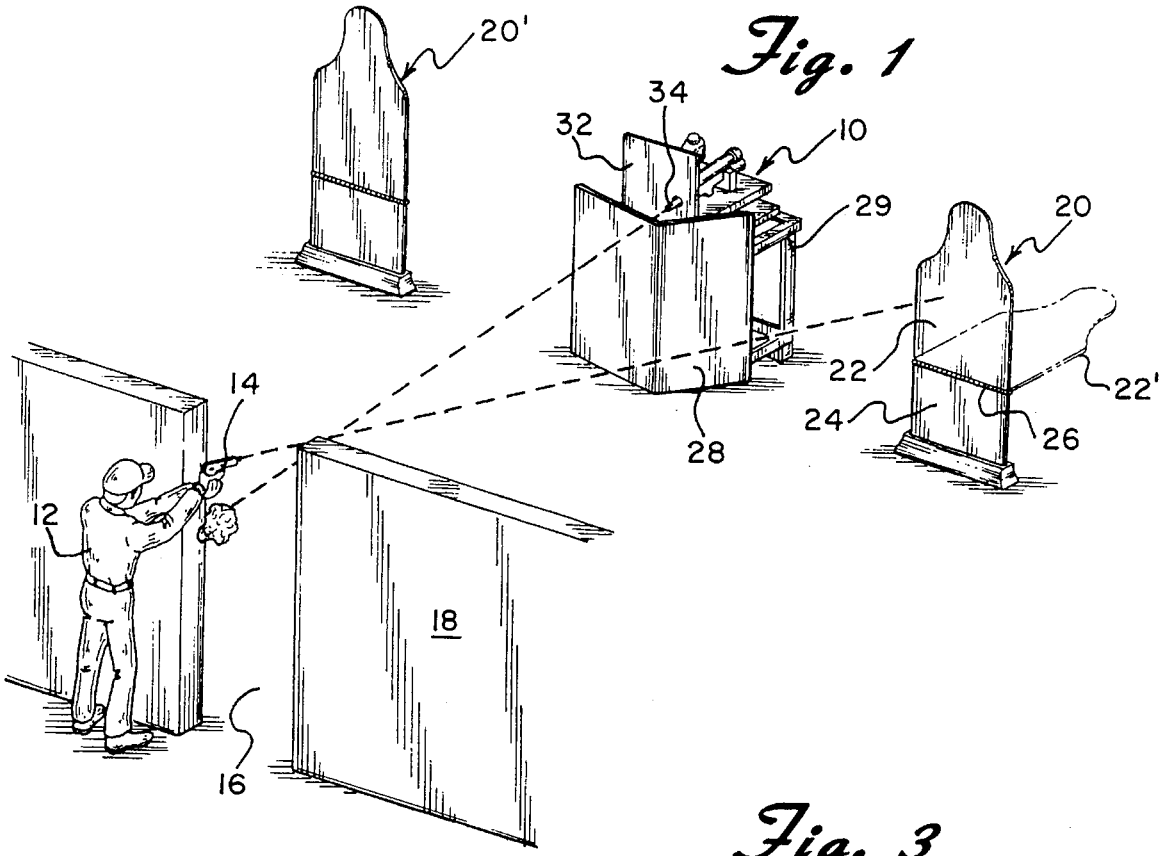
Fig. 1
Fig. 3
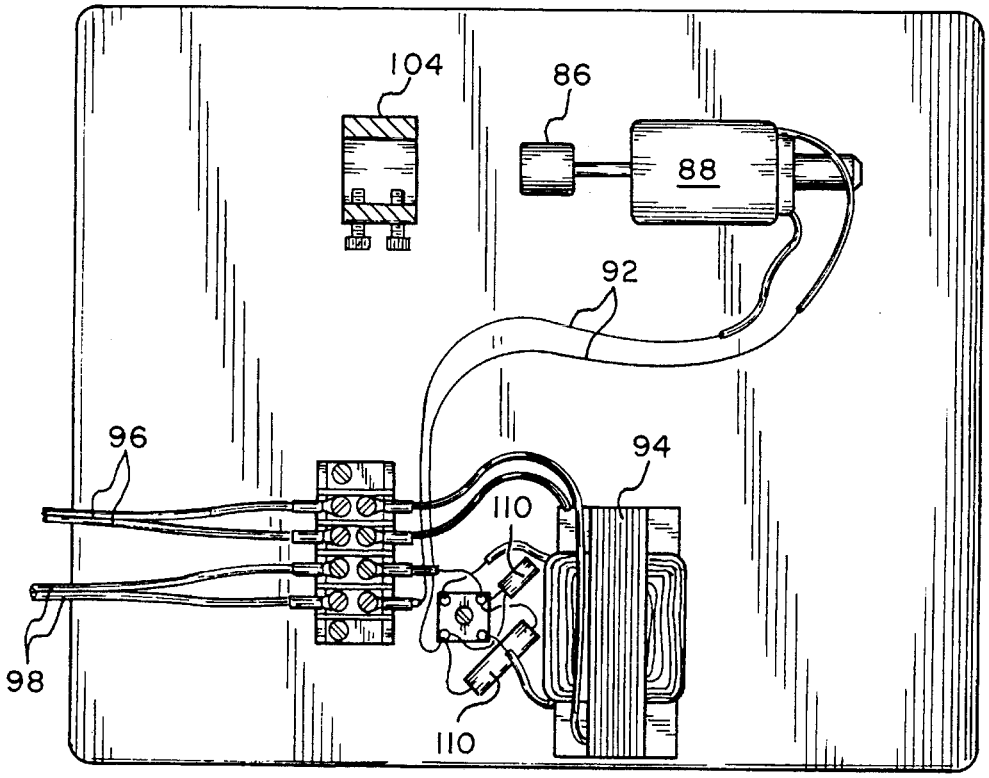

5
48
46
34
96
94
92
3
3
80
84
98
40
42
78
44
82
38
36
100
108
54
56
65
81
66
106
68
62
70
58
5

66
68
71
73
74
76
72

FIREARM USE TRAINING DEVICE AND METHOD

BACKGROUND OF THE INVENTION

This invention involves a training device and method to train a person in a live ammunition fire fight. More specifically, the invention involves a remote controlled projectile firing mechanism wherein the projectiles are harmless but mark the person in training while allowing that person to shoot with live ammunition from a firearm.

In police work and in military situations, hand to hand combat with armed weapons is sometimes necessary. It has long been desirable to train personnel so that they will be ready in case a armed conflict becomes necessary. A number of various training systems have been developed including a special range set up to simulate an actual setting where an armed conflict might occur. The trainee is instructed to move through the simulated scene, such as store fronts or house fronts in the simulated street scene. The trainee who is generally seeking to enter or maintain his or her position on a police force carries a loaded firearm and is instructed to shoot targets which flip up or are exposed as the trainee moves through the "street". Some of the targets are "friendly" and some of them simulate an immediate threat to life of the trainee, such as brandishing simulated weapons. The trainee is scored as to his or her speed and accuracy in hitting only the threatening targets. Other systems attempt to simulate the scene somewhat like a video game, however the use of a loaded weapon is missing from that type of training. What is needed is a training system and a device that will allow the trainee to use a loaded weapon while learning the skills of avoiding being shot by an armed "bad guy". For the purposes of this patent the term "firearm" is defined as a weapon, such as a small arms weapon, from which a projectile is fired by gun powder or any equivalent weapon that can injure a person from a distance.

A combat training system and apparatus is disclosed in U.S. Pat. No. 4,934,937 to Judd utilizing live ammunition being used by the trainee and simulating enemy fire through the use of a laser connected to the target. In U.S. Pat. No. 4,948,371 to Hall, a system for training and evaluation of security personnel in the use of firearms features a video display with the trainee using an infrared handgun against simulated fire by a person on the scene. In U.S. Pat. No. 2,569,594 to Aagesen, a projector is used to provide target reporting information with pop up targets allowing the trainee to use live ammunition. A target reporting system audibly advising the shooter of the success or failure of hitting the target is described in U.S. Pat. No. 5,095,533; a target indicating a shot scoring system for a firing range is described in U.S. Pat. No. 4,482,325; a miniaturized linear motion and pop-up target training system is described in U.S. Pat. No. 4,340,370; a direct fire weapon simulator using a screen and an illuminator fixed to a screen is described in U.S. Pat. No. 3,889,396; and a training apparatus for firearms use using a motion picture projected onto a screen is described in U.S. Pat. No. 3,849,910.

None of these devices and systems answer the above described need nor attain the objects described herein below.

SUMMARY OF INVENTION

The device and method using the device described herein below allows the use of a firearm with live ammunition in an attempt to hit targets which are close to a remotely operated gun that shoots projectiles that will indicate whether the trainee has been hit, but will not injure the trainee.

It is a particular object of the present invention to provide a device and method which will allow a realistic scenario using the trainees own weapon and ammunition while allowing the trainee to learn how to remain protected and hide from simulated "enemy" fire.

It is another object of the present invention to provide a device and method wherein the trainee can be instructed and tested in the use of his or her weapon while under fire including those circumstances where the firearm has a "simulated" jam.

It is an object of the present invention to provide a simulated pressure situation wherein there is a simulated risk to the trainee while he or she is trying to use a firearm with live ammunition, the pressure simulation not being able to be achieved by any other system or device.

A part of the device of this invention is a gun that shoots projectiles that provide an immediate indication of a "hit" on the trainee, but without injuring that trainee. An example of such a device is the well known "paint gun" which shoots round frangible plastic balls filled with paint that break upon impact with little risk to the person being hit. These devices are widely used for war games played by both adults and children. An example of such a gun is described in U.S. Pat. No. 4,936,282 to Gerrold M. Dobbins et al that issued on Jun. 26, 1990 describing a gas powered gun to propel paint containing frangible projectiles. This patent is incorporated herein by reference thereto. Other patents usable as guns in the present invention are described in U.S. Pat. Nos. 1,854,605, 4,854,294, 1,857,068, 3,345,977, and 5,001,555, and U.K. Patent No. 1,536,672, all incorporated herein by reference thereto.

An aspect of the invention is a method of training a person in combat that includes arming said person with a firearm with live ammunition. The method further includes providing a remotely operated projectile shooting device that includes gun means to shoot harmless projectiles that will mark said person on impact and aiming means to aim the gun means controlled from a remote location. The method also includes providing armor means to protect the remotely operated projectile shooting device from the live ammunition fired from the firearm and locating at least one target proximate the remotely operated projectile shooting device. The method then includes aiming and firing the remotely operated projectile shooting device directing fire of the harmless projectiles at said person and requiring said person to shoot the firearm and hit said target without being hit by a projectile fired from the remotely operated projectile shooting device.

It is preferred that the gun means be a pneumatic powered gun that propels frangible polymeric plastic balls filled with paint. It is preferred that the providing the remotely operated projectile shooting device include providing that the aiming means be to aim the gun means through a horizontal arc. It is also preferred that the providing the remotely operated projectile shooting device include providing that the aiming means include frame means supporting the gun means, an upper horizontal support panel comprising an upper surface to which the gun means is attached, rotateable means supporting and connecting the upper horizontal support panel to the frame means while allowing the upper horizontal support panel to rotate in a horizontal arc, and first movement means to rotate the upper horizontal support panel in an arc. It is further preferred that the providing remotely operated projectile shooting device include providing that the aiming means include frame means supporting a lower horizontal support panel, an upper horizontal support panel comprising an upper surface to which the gun means is attached, rotateable connection means connecting the upper horizontal support panel to the lower horizontal support panel while allowing the upper horizontal support panel to rotate in a horizontal arc, support means to support the upper horizontal support panel on and allow it to move freely on the lower horizontal support panel, and first movement means to rotate the upper horizontal support panel in arc around the pivot connection means. It is also preferred that the providing the remotely operated projectile shooting device includes providing that the aiming means include frame means supporting a lower horizontal support panel supporting the gun means, first pivot connection means pivotally connecting a rear end of the lower horizontal support panel on the frame means allowing vertical tilting from horizontal of a front end of the lower horizontal support member, second movement means to raise and lower a front end of the lower horizontal support panel, and second pivot connection means supporting and connecting the second movement means to the front end of the lower horizontal support panel. It is further preferred that the providing the armor means include providing a panel capable of preventing penetration of slugs from the firearm, the panel being connected to the gun means and moveable with the gun means as it is aimed by the aiming means.

Another aspect of the invention is a method of training a person in combat that includes arming said person with a firearm with live ammunition. The method further includes providing a remotely operated projectile shooting device that includes a gun that propels harmless frangible polymeric plastic balls filled with paint that will mark said person on impact and aiming means to aim the gun means controlled from a remote location. The aiming means includes frame means supporting the gun means, an upper horizontal support panel comprising an upper surface to which the gun means is attached, rotateable means supporting and connecting the upper horizontal support panel to the frame means while allowing the upper horizontal support panel to rotate in a horizontal arc, and first movement means to rotate the upper horizontal support panel in an arc. The method also includes providing armor means to protect the remotely operated projectile shooting device from the live ammunition fired from the firearm, the armor means including a panel capable of preventing penetration of slugs fired from the firearm, the panel being connected to the gun means and moveable with the gun means as it is aimed by the aiming means. The method further includes locating at least one target proximate the remotely operated projectile shooting device. The method then includes aiming and firing the remotely operated projectile shooting device directing fire of the harmless projectiles at said person, while requiring said person to shoot the firearm and hit said target without being hit by a projectile fired from the remotely operated projectile shooting device.

Yet another aspect of the invention is a remotely operated gun apparatus that includes gun means to shoot harmless projectiles that will mark a person on impact and aiming means to aim the gun means. The aiming means includes horizontal control means to adjust a horizontal direction of the aim, vertical control means to adjust a vertical direction of the aim, and remote control means to operate the horizontal control means and the vertical control means from a remote location. The apparatus further includes armor means to protect the gun means, the horizontal control means, and the vertical control means from damage by firearm fire. The armor means includes a panel capable of preventing penetration of slugs fired from a firearm, the panel being connected to the gun means and moveable with the gun means as it is aimed by the aiming means.

It is preferred that the aiming means include frame means supporting the gun means, an upper horizontal support panel comprising an upper surface to which the gun means is attached, rotateable means supporting and connecting the upper horizontal support panel to the frame means while allowing the upper horizontal support panel to rotate in a horizontal arc, and first movement means to rotate the upper horizontal support panel in an arc. It is further preferred that the aiming means include frame means supporting a lower horizontal support panel, an upper horizontal support panel comprising an upper surface to which the gun means is attached, rotatable connection means connecting the upper horizontal support panel to the lower horizontal support panel while allowing the upper horizontal support panel to rotate in a horizontal arc, support means to support the upper horizontal support panel on and allow it to move freely on the lower horizontal support panel, and first movement means to rotate the upper horizontal support panel in arc around the pivot connection means. It is also preferred that the aiming means include frame means supporting a lower horizontal support panel supporting the gun means, first pivot connection means pivotally connecting a rear end of the lower horizontal support panel on the frame means allowing vertical tilting from horizontal of a front end of the lower horizontal support member, second movement means to raise and lower a front end of the lower horizontal support panel, and second pivot connection means supporting and connecting the second movement means to the front end of the lower horizontal support panel. It is further preferred that the armor means include a panel capable of preventing penetration of slugs fired from a firearm, the armor means being connected to the gun means and moveable with the gun means as it is aimed by the aiming means.

BRIEF DESCRIPTION OF THE DRAWINGS

FIG. 1 is a perspective view illustrating a method of use of the invention.

FIG. 3 is a cross sectional view taken along lines 3—3 of FIG. 2.

DESCRIPTION OF PREFERRED EMBODIMENTS

Figure 2:
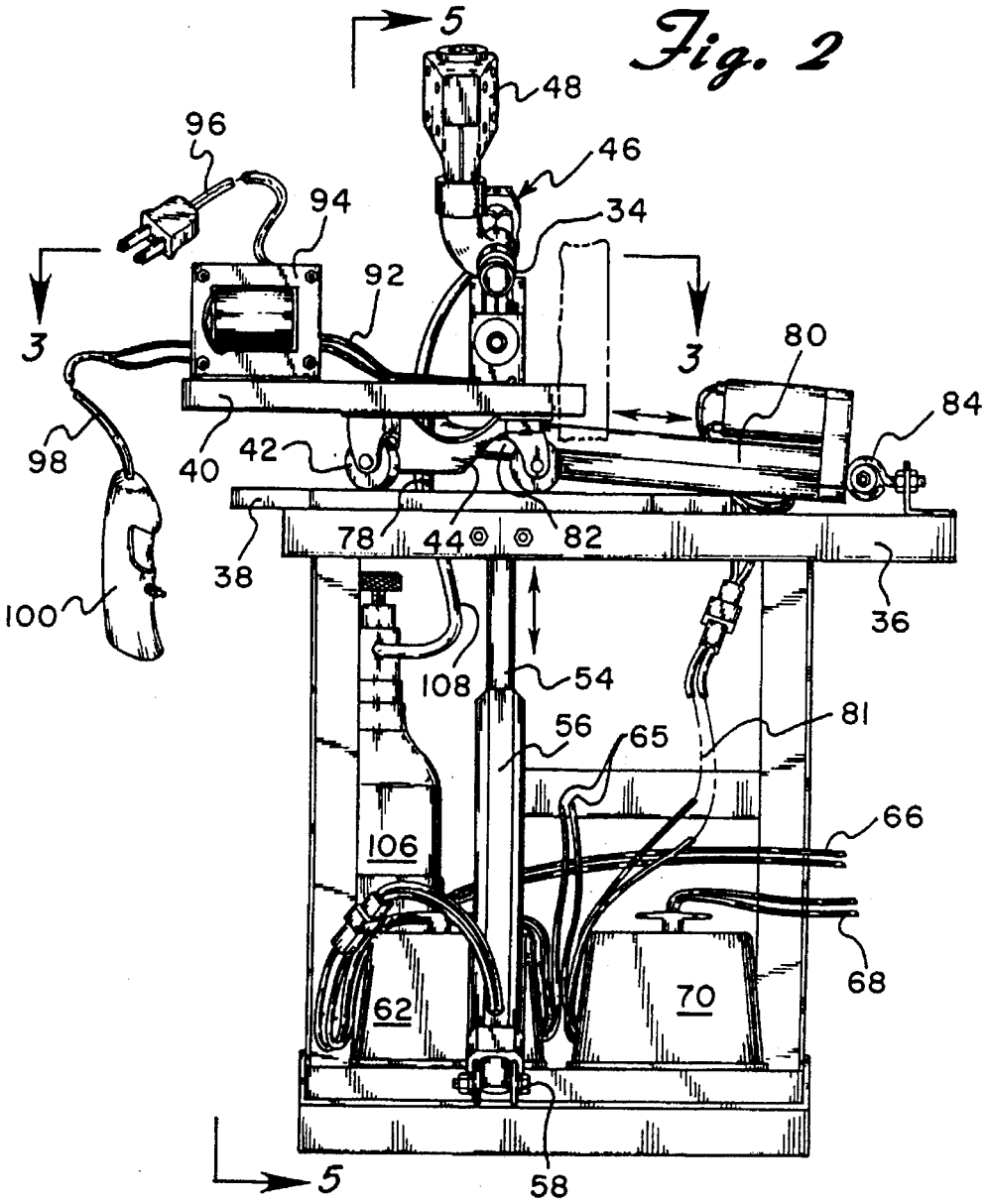
FIG. 2 is a front elevational view of an apparatus of the present invention with armor plates 28 and 32 removed.
Figure 4:
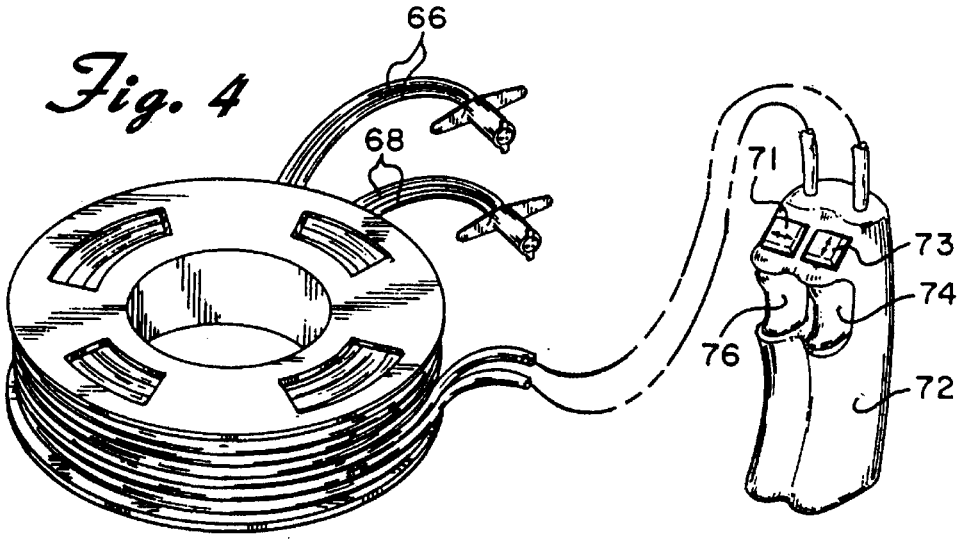
FIG. 4 is a perspective view of controllers used therein.
Figure 5:
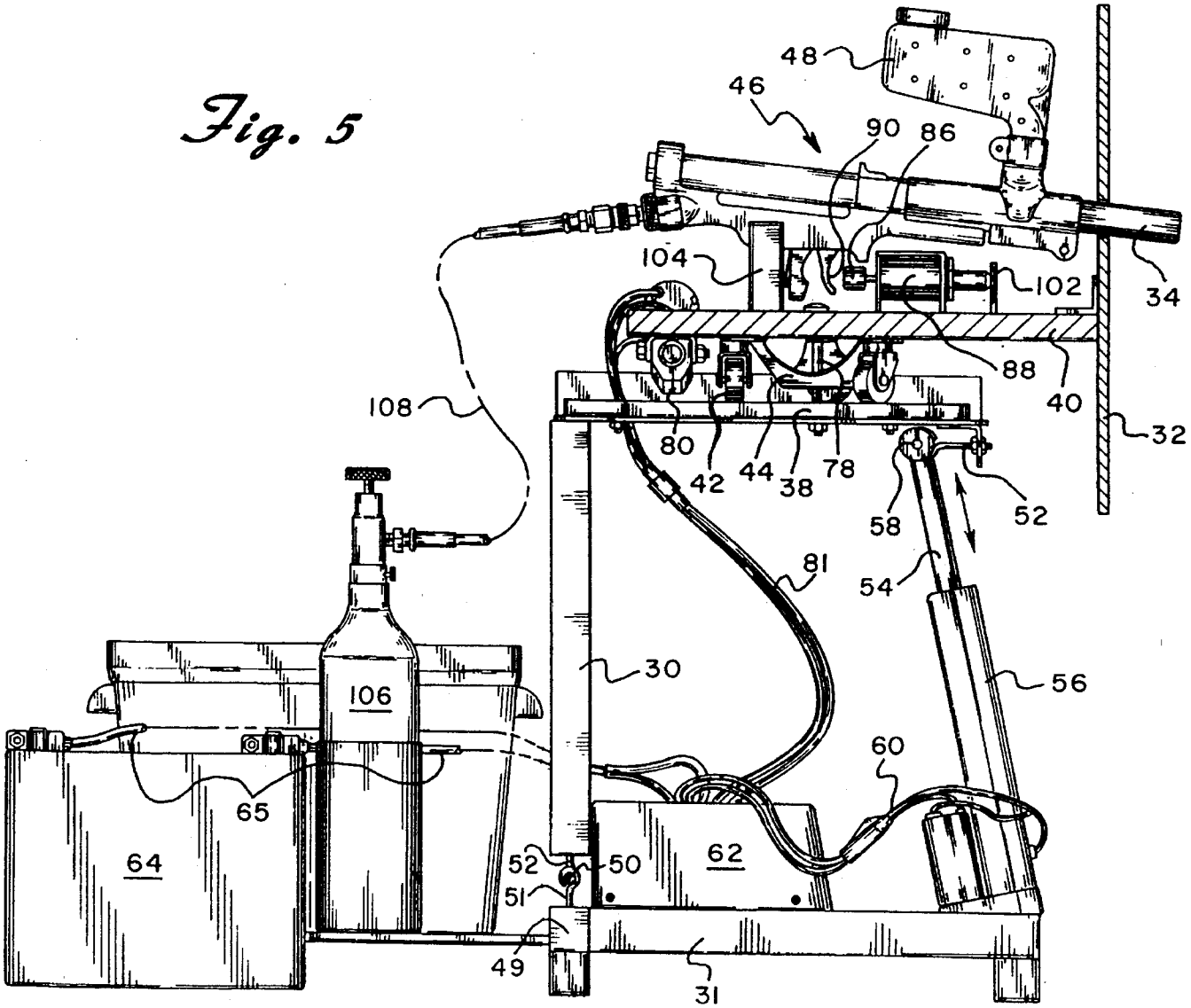
FIG. 5 is a side elevational view thereof taken along lines 5—5 of FIG. 2.

In FIG. 1, apparatus 10 is positioned to have trainee 12 within it's range of fire trainee 12 is aiming firearm 14 through opening 16 in wall 18 at target 20. Target 20 is a standard type of knock down target with upper section 22 hingeably attached along with hinge 26 to lower base section 24. Upper section 22 has a picture of a person (not shown) exhibiting a life threat to trainee 12. When upper section 22 is struck with a slug, it is knocked down to the position shown as shadow view 22' of the upper section. Additional targets may be used, such as target 20' essentially identical to target 20, but positioned on an opposite side to device 10. Apparatus 10 has one quarter inch steel armor plate 28 supported on frame support 29. A variety of armor plate constructions may be utilized and "V" shaped, ½ inch thick armor plate combination 28 rests on the ground to protect apparatus 10 from stray fire. Gun barrel 34 extends through movable armor plate 32 which protects the upper portion of apparatus 10. The steel of plate 32 can be replaced by a bullet proof vest type of construction utilizing KEVLAR® fiber composite construction to reduce weight and improve the portability of the device. It is intended that the targets will be easily observeable while the firing device will be positioned slightly behind the target and of a more neutral background color. With appropriate camouflage coating, device apparatus 10 will be virtually invisible so that only wild shots might strike the apparatus. As shown in FIGS. 2 and 5 the frame support including members 30 and 49 of base frame 31 are of heavy angle iron construction. Table panel 38 is supported at the top of the rear vertical support members 30 connected through rear pivot connection pins to rear horizontal frame member 49. Eye bolts 52 bolted to two lower ends of members 30 and eye bolts 51 bolted to horizontal member 49 are aligned to receive hinge pins 50. This pivot connection allows table 38 to tilt up and down from the horizontal thus aiming gun 46 vertically. The front of table panel 38 is supported by piston 54 extending vertically from Warner Electric linear actuator 56. An upper end of piston 54 of actuation 56 is connected through pivot connection 58 to eye member 52 extending from table 38. The base of actuator 56 is connected the base frame 31 section of the frame support. Linear actuator 56 is electrically connected through wire connections 60 to vertical switch box 62 and is powered by twelve volt battery 64 connected through wires 65. Switch box 62 contains heavy duty "winch type" electronic switches which are electrically connected through wires 66 to hand held remote controller 72 as shown in FIGS. 2 and 4. Likewise controller wires 68 connect horizontal switch box 70 to hand controller 72 equipped with vertical switch 73 and horizontal switch 71 and direction switches 74 and 76. When vertical switch 73/74 is depressed and button 76 is depressed, piston 54 is moved vertically upward by actuator 56 to incline panel 38 at a chosen angle to aim barrel 34 in the proper vertical direction. Likewise, depressing button 74 while holding down switch 73 will tilt panel 38 downwardly. Similarly, depressing horizontal switch 71 will move barrel 34 horizontally left when button 74 is depressed and horizontally right when button 76 is depressed. Linear actuator 80 is electrically connected through wires 81 to switch box 70, which is controlled through wires 68 by controller 72. This latter movement is accomplished by providing gun 46 held by bracket 104 on upper support panel 40 supported on wheels 42 which run on the upper surface of panel 38 as shown in FIG. 2. Wheels 42 are connected through wheel bracket 44 to the bottom surface of upper support panel 40. The horizontal movement of gun 46 is accomplished by rotating panel 40 in a 15 degree arc to the left and a 15 degree arc to the right pivoting on central pivot pin connection 78 which connects panel 40 with table panel 38 allowing panel 40 to rotate on wheels 42. The movement is accomplished by linear actuator 80 which is identical to unit 56. The rear end of actuator 80 is connected through pivot connection 84 to upper side edge of frame member 36 which supports panel 38 and also tilts upwardly and downwardly by movement of actuator 56. Piston 82 of actuator 80 is connected through a pivot connection hidden in this view to the underside of panel 40 about 2 to 5 inches away from pivot pin 78 with a connection mechanism similar to pivot connection 84. Thus, as shown in FIG. 2, movement outwardly of piston 82 by actuator 80 moves barrel 34 to the left while movement of piston 82 by actuator 80 moves barrel 34 to the right. Gun 46 has magazine 48 which provides a continuous supply of paint balls. Gun 46 is a slightly modified Model 68 Special from Tippmann Pneumatic, Inc. of Fort Wayne, Ind. powered through pressure line 108 from carbon dioxide pressure cylinder 106. As shown in FIGS. 3 and 5 the trigger guard has been removed allowing rubber head 86 of solenoid 88 to strike trigger 90 when actuated by current supplied through wires 96 connected into a 110 volt AC to transformer 94 and wires 92. Trigger remote controller 100 is connected through wires 98 which momentarily provides current from series capacitors 110 to solenoid 88 pushing trigger 90 to fire gun 46. The return spring of trigger 90 easily returns head 86 of the solenoid against stop 102 since the current to the-solenoid is only momentary. The solenoid is a twenty-four volt fifty OHM unit from Guardian Electronics.

Although the system shown is all hard wired, it should be clear that the remote controller may utilize electronic signals to direct movement of the gun and fire the gun. Controllers used for toy cars and the like may be utilized.

While this invention has been described with reference to specific embodiments disclosed herein, it is not confined to the details set forth and the patent is intended to include modifications and changes which may come within and extend from the following claims.

I claim:

1. A method of training a person in combat comprising:

(a) arming said person with a firearm with live ammunition, (b) providing a remotely operated projectile shooting device comprising:

(i) gun means to shoot harmless projectiles that will mark said person on impact, (ii) aiming means to aim the gun means controlled from a remote location, and (iii) feeding means to hold said projectiles and feed same to said gun means, (c) plating a supply Of said projectiles in said feeding means, (d) providing armor means to protect the remotely operated projectile shooting device from the live ammunition fired from the firearm, (e) locating at least one target proximate the remotely operated projectile shooting device, (f) aiming and firing the remotely operated projectile shooting device directing fire of the harmless projectiles at said person, and (g) requiring said person to shoot the firearm and hit said target without being hit by a projectile fired from the remotely operated projectile shooting device.

2. The method of claim 1 wherein providing the remotely operated projectile shooting device further comprises providing that the gun means be a pneumatic powered gun that propels frangible polymeric plastic balls filled with paint.

3. The method of claim 1 wherein providing the remotely operated projectile shooting device further comprises providing that the aiming means be to aim the gun means through a horizontal arc.

4. The method of claim 1 wherein providing the remotely operated projectile shooting device further comprises providing that the aiming means comprises:

(a) frame means supporting the gun means, (b) an upper horizontal support panel comprising an upper surface to which the gun means is attached, (c) rotateable means supporting and connecting the upper horizontal support panel to the frame means while allowing the upper horizontal support panel to rotate in a horizontal arc, and (d) first movement means to rotate the upper horizontal support panel in an arc.

5. The method of claim 1 wherein providing the remotely operated projectile shooting device further comprises providing that the aiming means comprises:

(a) frame means supporting a lower horizontal support panel, (b) an upper horizontal support panel comprising an upper surface to which the gun means is attached, (c) rotatable connection means connecting the upper horizontal support panel to the lower horizontal support panel while allowing the upper horizontal support panel to rotate in a horizontal arc, (d) support means to support the upper horizontal support panel on and allow it to move freely on the lower horizontal support panel, and (e) first movement means to rotate the upper horizontal support panel in arc around the pivot connection means.

6. The method of claim 1 wherein providing the remotely operated projectile shooting device further comprises providing that the aiming means comprises:

(a) frame means supporting a lower horizontal support panel supporting the gun means, (b) first pivot connection means pivotally connecting a rear end of the lower horizontal support panel on the frame means allowing vertical tilting from horizontal of a front end of the lower horizontal support member, (d) second movement means to raise and lower a front end of the lower horizontal support panel, and (e) second pivot connection means supporting and connecting the second movement means to the front end of the lower horizontal support panel.

7. The method of claim 1 wherein providing the armor means further comprises providing a panel capable of preventing penetration of slugs from the firearm, the panel being connected to the gun means and moveable with the gun means as it is aimed by the aiming means.

8. A method of training a person in combat comprising:

(A) arming said person with a firearm with live ammunition, (B) providing a remotely operated projectile shooting device comprising:

(i) a gun that propels harmless frangible polymeric plastic balls filled with paint that will mark said person on impact, (ii) aiming means to aim the gun means controlled from a remote location comprising:

(a) frame means supporting the gun means, (b) an upper horizontal support panel comprising an upper surface to which the gun means is attached, (c) rotateable means supporting and connecting the upper horizontal support panel to the frame means while allowing the upper horizontal support panel to rotate in a horizontal arc, and (d) first movement means to rotate the upper horizontal support panel in an arc, and (iii) feeding means to hold said balls and feed same to said gun, (C) placing a supply of said balls in said feeding means, (D) providing armor means to protect the remotely operated projectile shooting device from the live ammunition fired from the firearm, the armor means comprising a panel capable of preventing penetration of slugs fired from the firearm, the panel being connected to the gun means and moveable with the gun means as it is aimed by the aiming means, (E) locating at least one target proximate the remotely operated projectile shooting device, (F) aiming and firing the remotely operated projectile shooting device directing fire of the harmless projectiles at said person, and (G) requiring said person to shoot the firearm and hit said target without being hit by a projectile fired from the remotely operated projectile shooting device.

9. A remotely operated gun apparatus comprising:

(a) gun means to shoot harmless projectiles that will mark a person on impact, (b) aiming means to aim the gun means comprising:

(i) horizontal control means to adjust a horizontal direction of the aim, (ii) vertical control means to adjust a vertical direction of the aim, and (iii) remote control means to operate the horizontal control means and the vertical control means from a remote location, and (c) armor means to protect the gun means, the horizontal control means, and the vertical control means from damage by firearm fire, wherein the armor means comprises a panel capable of preventing penetration of slugs fired from a firearm, the panel being connected to the gun means and moveable with the gun means as it is aimed by the aiming means.

10. The apparatus of claim 9 wherein the gun means comprises a pneumatic powered gun that propels frangible polymeric plastic balls filled with paint.

11. The apparatus of claim 9 wherein the aiming means further comprises:

(a) frame means supporting the gun means, (b) an upper horizontal support panel comprising an upper surface to which the gun means is attached, (c) rotateable means supporting and connecting the upper horizontal support panel to the frame means while allowing the upper horizontal support panel to rotate in a horizontal arc, and (d) first movement means to rotate the upper horizontal support panel in an arc.

12. The apparatus of claim 9 wherein the aiming means, further comprises:

(a) frame means supporting a lower horizontal support panel, (b) an upper horizontal support panel comprising an upper surface to which the gun means is attached, (c) rotateable connection means connecting the upper horizontal support panel to the lower horizontal support panel while allowing the upper horizontal support panel to rotate in a horizontal arc, (d) support means to support the upper horizontal support panel on and allow it to move freely on the lower horizontal support panel, and (e) first movement means to rotate the upper horizontal support panel in arc around the pivot connection means.

13. The apparatus of claim 9 wherein the aiming means further comprises:

(a) frame means supporting a lower horizontal support panel supporting the gun means, (b) first pivot connection means pivotally connecting a rear end of the lower horizontal support panel on the frame means allowing vertical tilting from horizontal of a front end of the lower horizontal support member, (d) second movement means to raise and lower a front end of the lower horizontal support panel, and (e) second pivot connection means supporting and connecting the second movement means to the front end of the lower horizontal support panel.

* * * * *